US005568972A

United States Patent [19]

Wang

[11] Patent Number: 5,568,972

[45] Date of Patent: Oct. 29, 1996

[54] LAMP HOUSING ASSEMBLY

[76] Inventor: Lyu-Shong Wang, No. 5, Lane 30, Ta Chou Road, Shern Kang Hsiang, Taichung, Taiwan

[21] Appl. No.: 517,071

[22] Filed: Aug. 21, 1995

[51] Int. Cl.[6] ..... F21S 1/06

[52] U.S. Cl. ..... 362/405; 362/406; 362/457

[58] Field of Search ..... 362/404, 405, 362/457, 406, 806, 458; 248/223.41

[56] References Cited

U.S. PATENT DOCUMENTS 5,181,777 1/1993 Segill et al. ..... 362/405
5,255,173 10/1993 Schonbeck ..... 362/405

FOREIGN PATENT DOCUMENTS 584417 10/1958 Italy ..... 362/405

*Primary Examiner*—Denise L. Gromada
*Assistant Examiner*—Thomas M. Sember
*Attorney, Agent, or Firm*—Charles E. Baxley, Esq.

[57] ABSTRACT

A lamp housing includes a board having a number of notches formed in the peripheral portion. The notches each includes a narrower opening portion. A number of attachment members each include a neck portion for engaging with the opening portions of the notches. Each attachment member includes an enlarged portion for engaging with the board so as to secure the attachment members to the board. The neck portions may include a cavity or a projection for engaging with the key or the recess of the board so as to prevent the attachment members from rotating relative to the board.

5 Claims, 7 Drawing Sheets

LAMP HOUSING ASSEMBLY

BACKGROUND OF THE INVENTION

1. Field of the Invention

The present invention relates to a lamp housing, and more particularly to a lamp housing assembly.

2. Description of the Prior Art

Typical lamps or lamp housings comprise a definite shape and configuration that may not be changed with various kinds of attachment.

The present invention has arisen to mitigate and/or obviate the afore-described disadvantages of the conventional lamp housings.

SUMMARY OF THE INVENTION

The primary objective of the present invention is to provide a lamp housing assembly which may be attached with various kinds of attachment members so as to be changed to various configurations and shapes.

In accordance with one aspect of the invention, there is provided a lamp housing assembly comprising a board including a peripheral portion having a plurality of notches formed therein, the notches each includes an opening portion of relatively narrow size, and a plurality of attachment members each includes a neck portion for engaging with the opening portions of the notches and each includes an enlarged portion formed above the neck portion for engaging with the board so as to secure the attachment members to the board.

The board includes a plurality of teeth extended inward of the notches. The neck portions and the enlarged portions of the attachment members each includes a plurality of ribs for engaging with the teeth of the board so as to prevent the attachment members from rotating relative to the board.

The board includes a plurality of depressions formed in the peripheral portion thereof and arranged around the notches, and the enlarged portions of the attachment members each includes a plurality of bulges formed thereon for engaging with the depressions as to prevent the attachment members from rotating relative to the board.

The board includes a plurality of keys extended inwardly of the notches respectively, the neck portions of the attachment members each includes a cavity formed therein for engaging with the keys of the board such that the attachment member is prevented from rotating relative to the board and such that the attachment members are solidly secured to the board.

The neck portions of the attachment members each includes a projection formed therein, the board includes a plurality of recesses formed beside the notches respectively for engaging with the projections of the board such that the attachment member is prevented from rotating relative to the board and such that the attachment members are solidly secured to the board.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
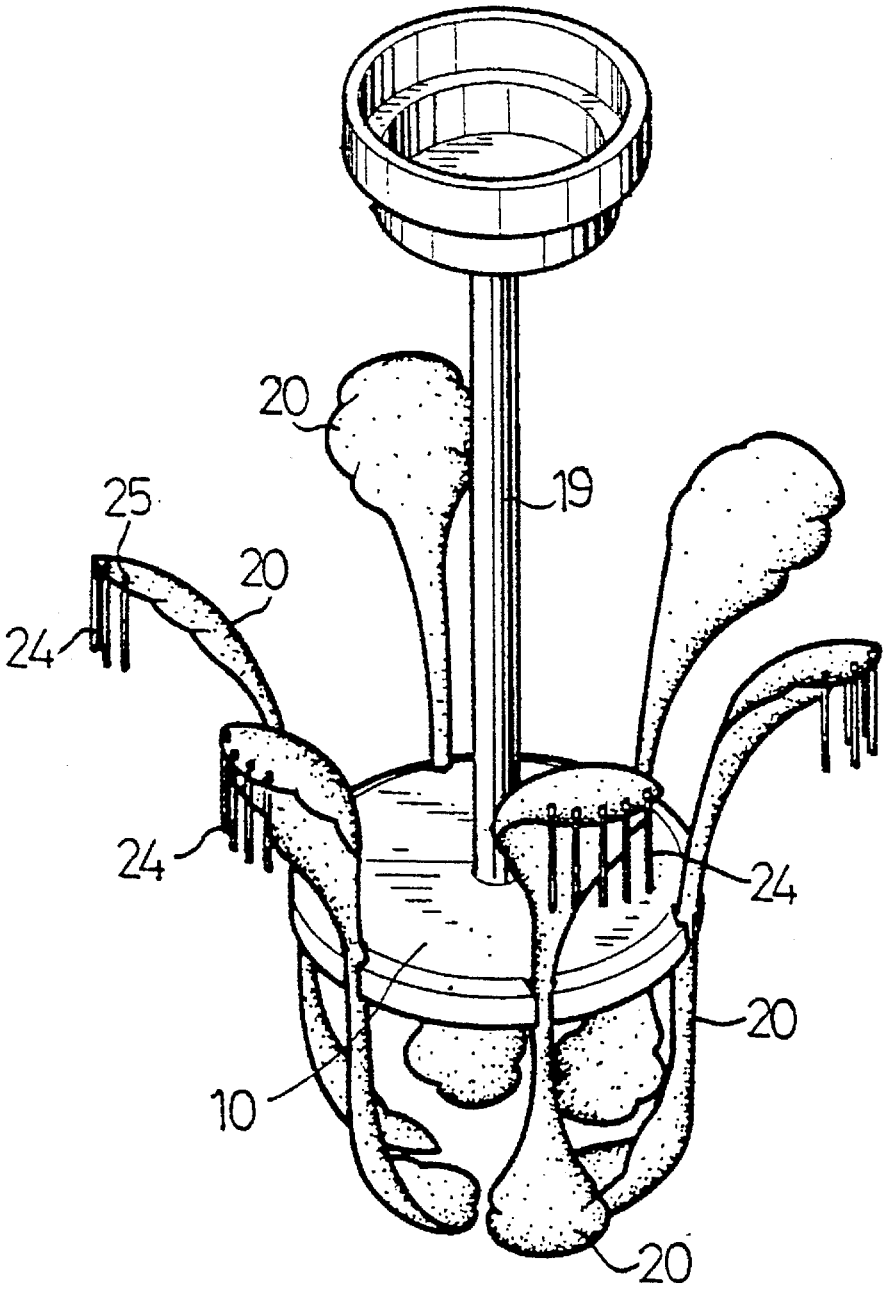
FIG. 1 is a perspective view of a lamp housing assembly in accordance with the present invention.
Figure 2:
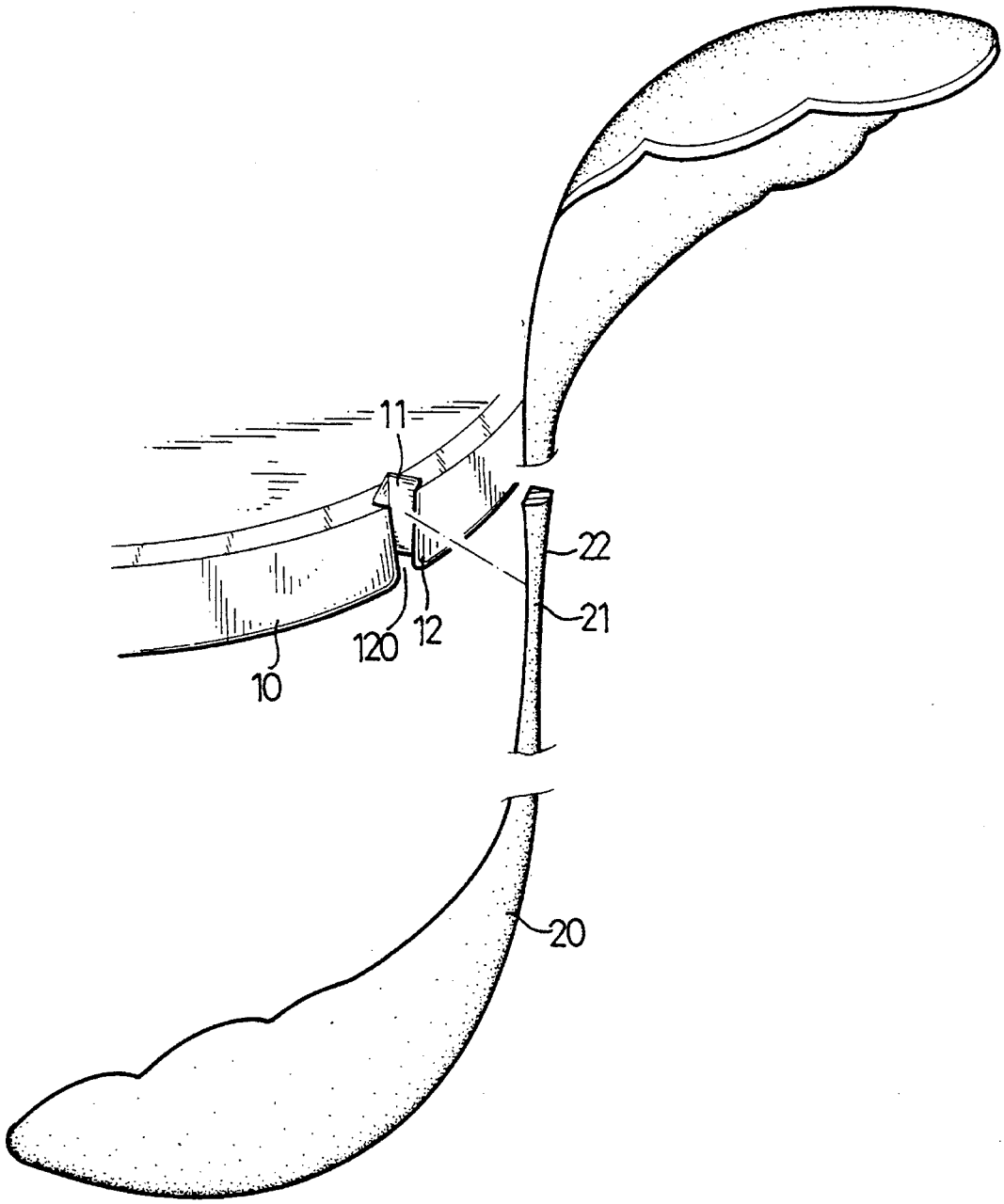
FIGS. 2 and 3 are partial exploded views of the lamp housing assembly.

Referring to the drawings, and initially to FIGS. 1 and 2, a lamp housing assembly in accordance with the present invention comprises a board 10 which may include a rod 19 extended upward therefrom for attaching the board to another object such as a ceiling. The board 10 includes a peripheral portion having a number of notches 11 formed therein and having a number of flanges 12 extended inwardly of the notches 11, preferably extended inwardly of the opening portions 120 of the notches 11 such that the opening portions 120 of the notches 11 each has a smaller size than that of the notches 11. A number of attachment members 20 each includes a neck portion 21 for engaging through the narrower opening portions 120 of the notches 11 and each includes an enlarged portion 22 formed above the neck portion 21 for engaging with the board 10 such that the attachment members 20 may be easily secured to the board 10 without any further fastening members. The attachment members 20 may each include a number of holes 25 formed therein for engaging with a number of rods 24. The engagement between the rods 24 and holes 25 may be similar to that between the attachment members 20 and the notches 11 of the board 10. It is preferable that the notches 11 each includes a cross section other than a circular cross section; i.e., the cross section of the notches 11 is not a circular cross section; and the attachment member includes a corresponding cross section for engaging with the notches 11 such that the attachment members may be prevented from rotating relative to the board.

Figure 3:
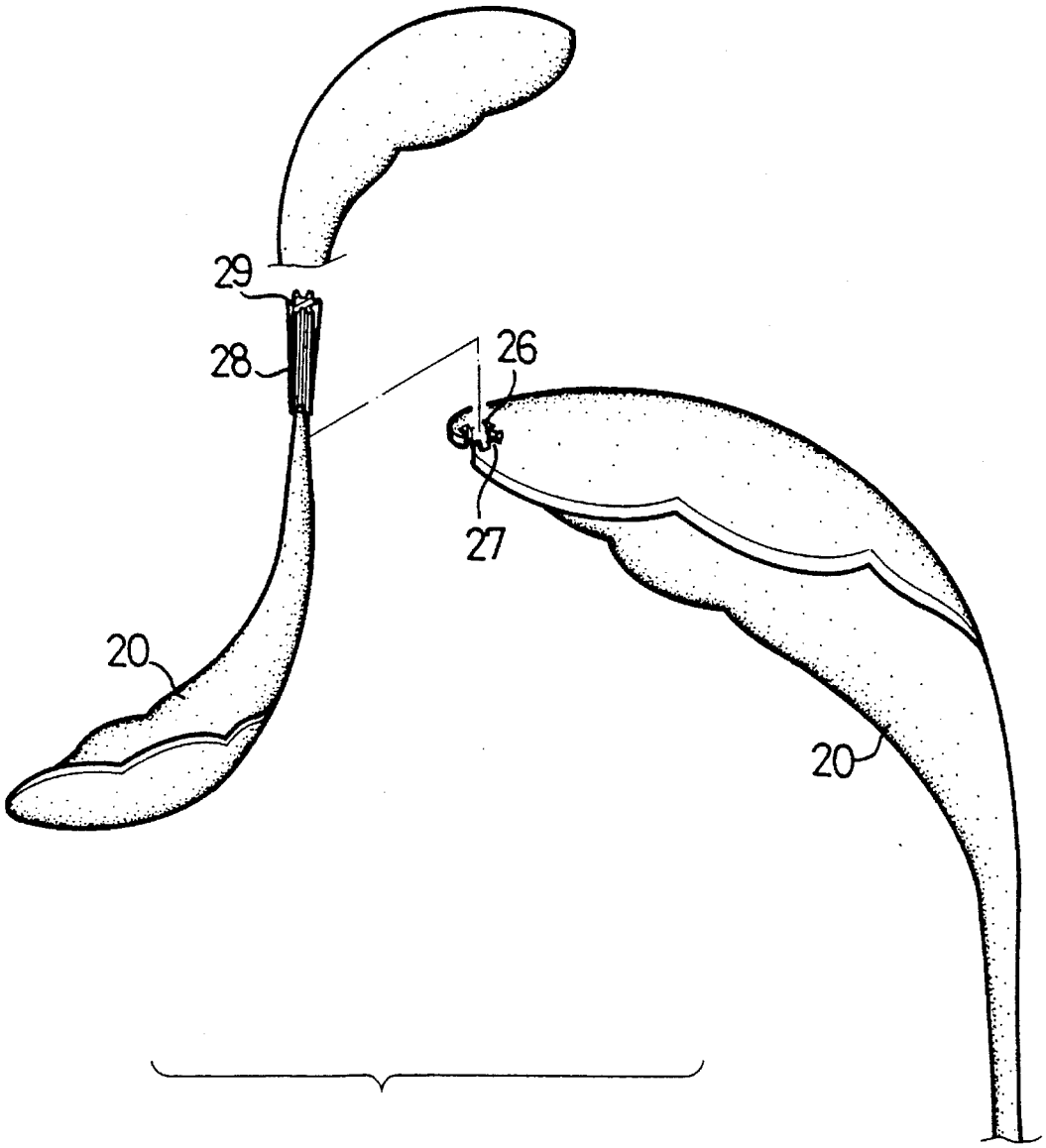

Referring next to FIG. 3, alternatively, the board or the attachment member 20 may include a notch 26 having a number of teeth 27 extended radially inward of the notches 26, and the attachment members 20 may each include a neck portion 28 and an enlarged portion having a number of ribs 29 formed thereon for engaging with the grooves formed between the teeth 27 such that the attachment members 20 may be easily secured to the board 10 or to the other attachment members 20 and such that the attachment member 30 may be prevented from rotating relative to the board 10.

Figure 4:
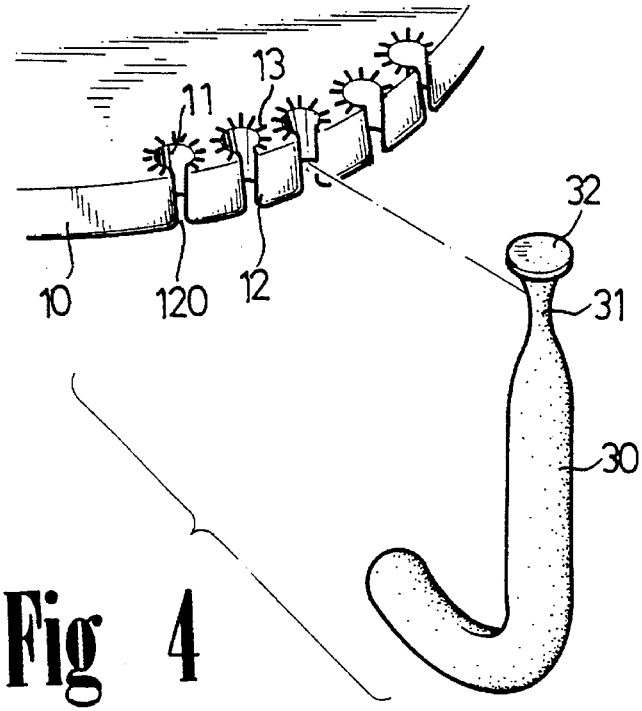
FIGS. 4 and 5 are partial exploded views showing another application of the lamp housing assembly.
Figure 5:
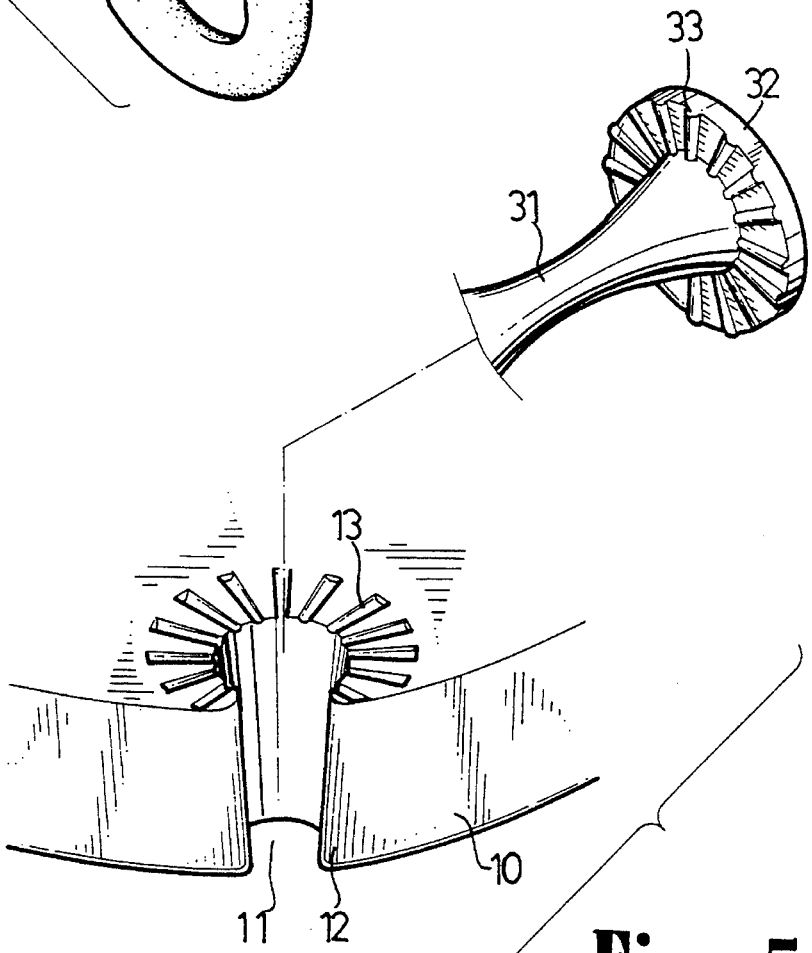
Figure 6:
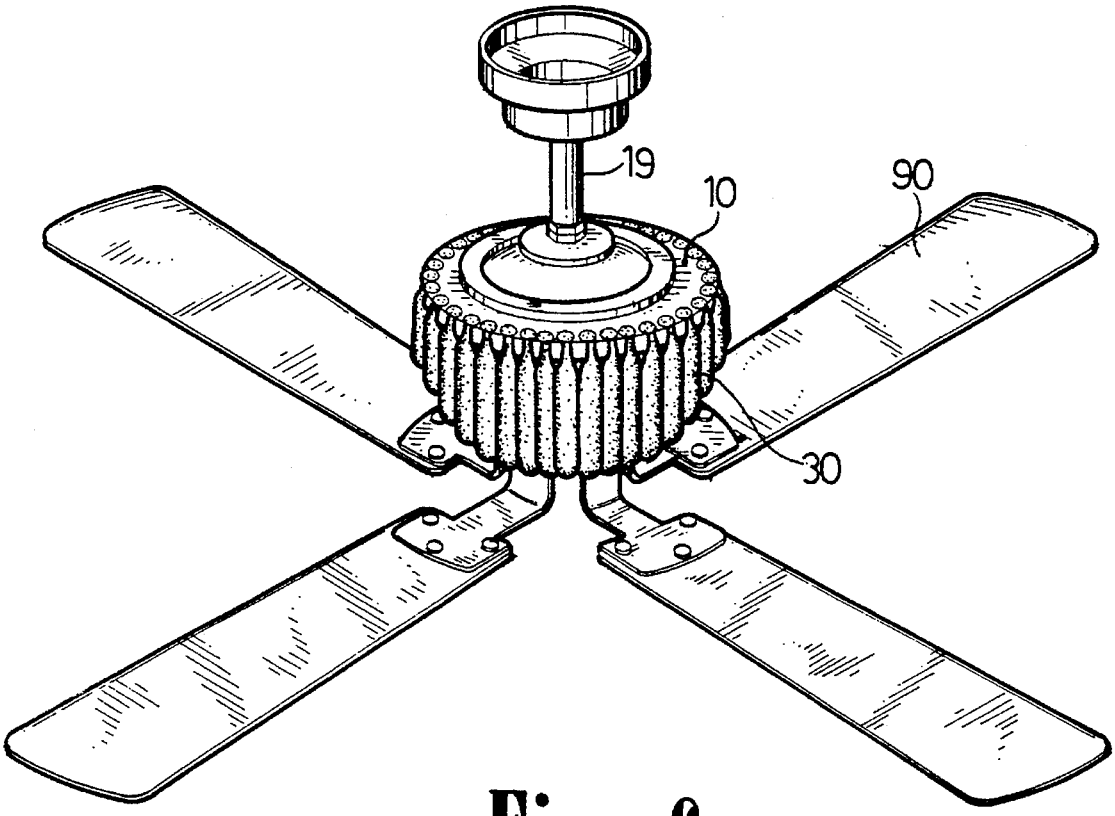
FIG. 6 is a perspective view showing the lamp housing assembly as shown in FIGS. 4 and 5.

Referring next to FIGS. 4 to 6, the notches 11 of the board 10 also each include a narrower opening portion 120. The board 10 further includes a number of depressions 13 formed in the peripheral portion and formed around the notches 11. The attachment members 30 each also includes a neck portion 31 for engaging with the narrower opening portion 120 and each includes an enlarged portion 32 for engaging with the board 10 such that the attachment members 30 may also be easily secured to the board. The enlarged portion 32 of the attachment member 30 each includes a number of bulges 33 for engaging with the depressions 13 of the board such that the attachment member 30 may be prevented from rotating relative to the board 10. As shown in FIG. 6, the board 10 and the attachment members 30 may be secured to the supporting rod 9 of the ceiling fan 90 so as to form a ceiling fan housing.

Figure 7:
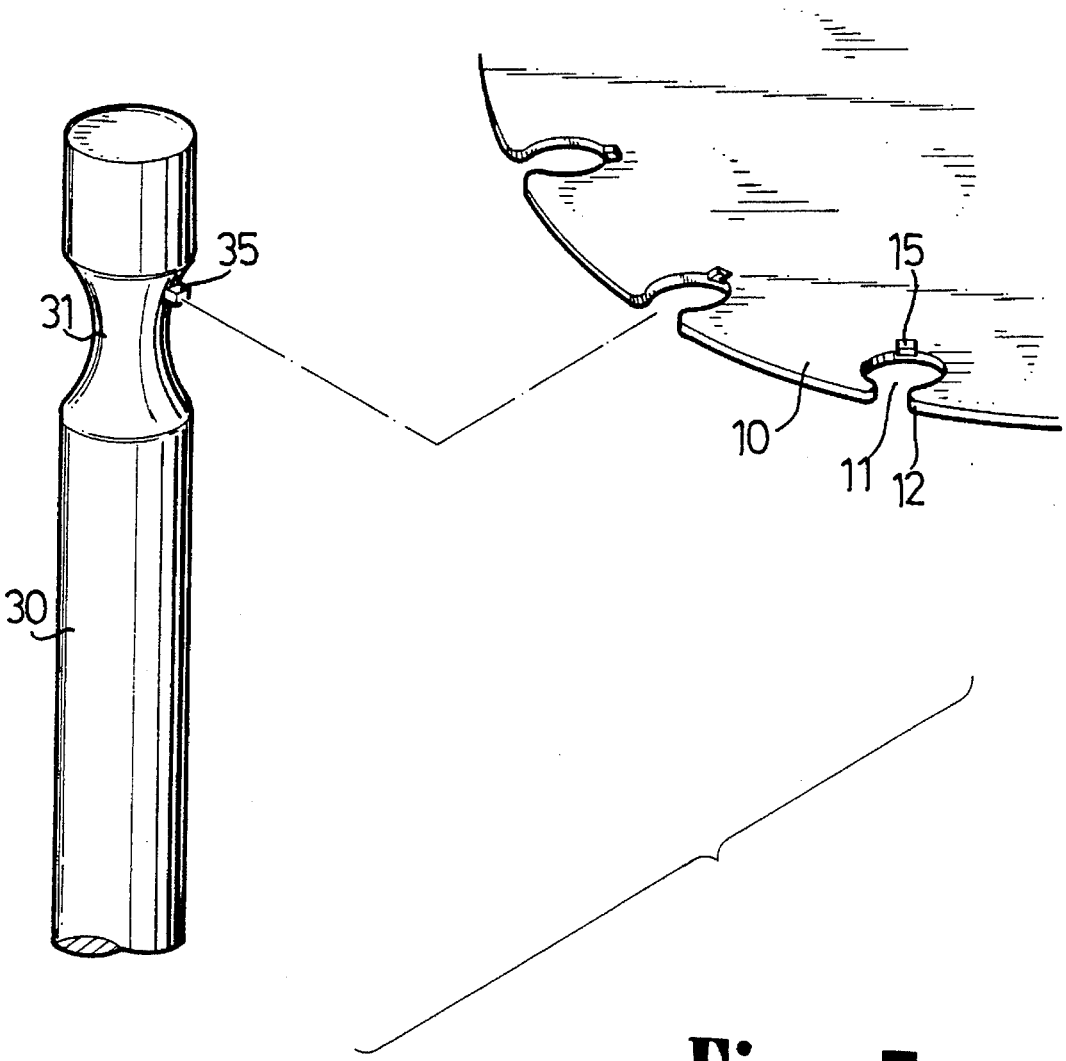
FIGS. 7 and 8 are partial exploded views showing a further application of the lamp housing assembly.
Figure 8:
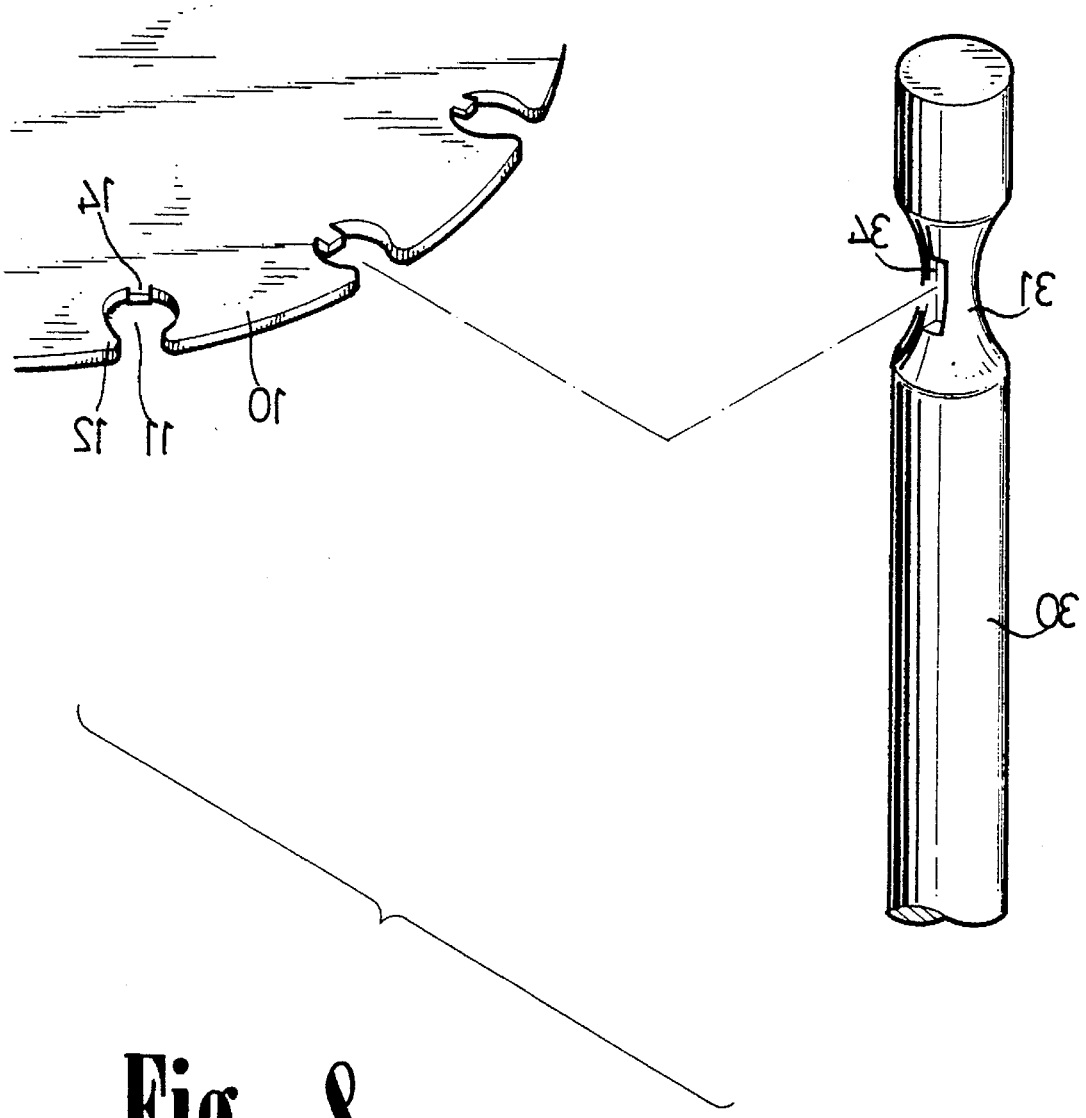

Referring next to FIGS. 7 and 8, the neck portions 31 of the attachment members 30 may each include a cavity 34 or a projection 35 for engaging with the relative keys 14 or recesses 15 of the board 10 such that the attachment member 30 may also be prevented from rotating relative to the board 10 and such that the attachment members 30 may be solidly secured to the board 10.

Accordingly, the lamp housing assembly in accordance with the present invention includes a number of attachment members that may be easily assembled or attached onto the board without any additional fastening means. In addition, the attachment members may be replaced with different configurations so as to change the configuration of the lamp housing.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lamp housing assembly comprising:

a board including a peripheral portion having at least one notch formed therein, said notch defining an opening of relatively narrow size, said opening having a pair of flanges extending inwardly toward each other, the flanges having a wider upper portion and a narrower lower portion, and an attachment member including a neck portion for engaging within said notch and including an enlarged upper portion formed above said neck portion for engaging between said flanges so as to secure said attachment member to said board.

2. The lamp housing assembly according to claim 1, wherein said board defines at least one longitudinal groove extending inwardly of said at least one notch so as to receive a mating longitudinal rib formed on said attachment member.

3. The lamp housing assembly according to claim 2, wherein said neck portion includes a plurality of ribs for engaging with a plurality of the grooves of said board.

4. The lamp housing assembly according to claim 1, wherein said notch forms any suitable cross-sectional shape selected from a group consisting of a polygonal shape, a pyramid shape, a water drop shape and a sector shape.

5. The lamp housing assembly according to claim 1, wherein said neck portion includes a shape corresponding to the cross-sectional shape of said notch.

* * * * *